US009415929B2

(12) United States Patent
Liu

(10) Patent No.: US 9,415,929 B2
(45) Date of Patent: Aug. 16, 2016

(54) ELECTRONIC CIGARETTE CASE

(71) Applicant: Qiuming Liu, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 379 days.

(21) Appl. No.: 14/056,591

(22) Filed: Oct. 17, 2013

(65) Prior Publication Data

US 2015/0034507 A1 Feb. 5, 2015

(30) Foreign Application Priority Data

Jul. 31, 2013 (CN) ..... 2013 2 0464007 U

(51) Int. Cl.
*B65D 85/10* (2006.01)
*A24F 15/12* (2006.01)
*A24F 47/00* (2006.01)

(52) U.S. Cl.
CPC ..... *B65D 85/10* (2013.01); *A24F 15/12* (2013.01); *A24F 47/008* (2013.01)

(58) Field of Classification Search
CPC ..... B65D 85/10; A24F 15/12; A24F 47/008
USPC ..... 206/250, 251, 254, 255, 256, 261, 263, 206/265, 267, 268, 817; 131/329; 220/810–813, 815, 816, 820; 229/160.1, 87.13
See application file for complete search history.

(56) References Cited

U.S. PATENT DOCUMENTS 1,735,325 A * 11/1929 Enfant ..... B65D 5/728 206/256
2,296,772 A * 9/1942 Crist ..... A24C 5/42 206/256
2,339,656 A * 1/1944 Shina ..... B65D 5/0005 206/268
3,127,083 A * 3/1964 Guyer ..... B65D 5/728 206/250
4,253,568 A * 3/1981 Long ..... G11B 23/0233 220/815
2005/0269220 A1* 12/2005 Focke ..... B65B 61/182 206/242
2007/0246383 A1* 10/2007 He ..... B65D 7/06 206/268
2009/0045084 A1* 2/2009 Roila ..... B65D 85/1036 206/268

* cited by examiner

*Primary Examiner* — Luan K Bui
(74) *Attorney, Agent, or Firm* — Tim Tingkang Xia, Esq.; Locke Lord LLP

(57) ABSTRACT

The present application relates to an electronic cigarette case, comprising a case body with an opening defined on the top of the case body, and a case cover which covers the case body; the case cover includes a cover body and a connection portion which is extending from one side of the cover body to the bottom of the case body in the direction of far away from the top of the cover body; an notch corresponding to the position of the case cover is defined in the case body, the shape of the notch matches with the shape of the case cover, and the connection portion is connected to the case body rotationally. When implementing the electronic cigarette case of the present application, it is easy to take out the cigarettes, and the effect of user experience is well.

6 Claims, 9 Drawing Sheets

ELECTRONIC CIGARETTE CASE

CROSS-REFERENCE TO RELATED APPLICATIONS

This non-provisional application claims priorities under 35 U.S.C. §119(a) on Patent Application No. 201320464007.X filed in P.R. China on Jul. 31, 2013, the entire contents of which are hereby incorporated by reference.

TECHNICAL FIELD

The present application relates to the field of electric cigarette, and more particularly, relates to an electronic cigarette case.

BACKGROUND

Smoking is harmful to the health. With the improvement of healthy consciousness, more and more people get to know the dangers of the smoking Smoking is not only harmful to the body of the smoker himself, but also harmful to the people around. At present, one kind of electronic cigarette is developed, which has the same appearance with a common cigarette, and it will generate smoke which contains no harmful substance such as tar during suction, and is healthier than the common cigarette.

An electronic cigarette is equipped with an electronic cigarette case for the accommodation of electronic cigarette. In the prior art, the electronic cigarette case generally comprises a case body and a case cover disposed on a side wall of a long edge of the case body, the case cover can be flipped up and down around the case body. However, the typical electronic cigarette case described above has smaller opening, and is not easy to take a cigarette out; besides, the form that flipping up and down is simple, which can not satisfy the personalized needs of customers.

BRIEF SUMMARY

The objective of the present application is to provide an electronic cigarette case, which has larger opening and is easy to take a cigarette out, aiming at the drawbacks that the above-mentioned electronic cigarette case has a smaller opening, not easy to take a cigarette out, and the form is simple in the prior art.

The technical solutions of the present application for solving the technical problems are as follows:

In one aspect, the present application provides an electronic cigarette case, which comprises a case body with an opening defined on the top of the case body, and a case cover which covers the case body; the case cover includes a cover body and a connection portion extending from one side of the cover body to the bottom of the case body in the direction of far away from the top of the cover body; an notch corresponding to the position of the case cover is defined in the case body, the shape of the notch matches with the shape of the case cover, and the connection portion is connected to the case body rotationally.

In one embodiment, the inside of the case body and the inside of the case cover together form an accommodation cavity for accommodating electronic cigarettes; a fixed base is positioned within the accommodation cavity, which is configured for inserting the electronic cigarette, and the fixe base can slide relative to the case body along the direction of inserting the electronic cigarette. In this embodiment, a sliding rod is mounted on the inner wall of the case body, and a sliding slot matching with the sliding rod is formed on the outer wall of the fixed base; or a sliding rod is mounted on the outer wall of the fixed base and a sliding slot matching with the sliding rod is formed on the inner wall of the case body; the sliding rod may be slidably deposited within the sliding slot. The electronic cigarette case in this embodiment further includes a buckling part which is configured to buckle together the case body and the case cover; the buckling part includes a buckle which is mounted on the case body or the fixed base, and a buckle placement matching with the buckle which is formed on the case cover; when the cover is closed, the buckle is deposited within the buckle placement.

In this embodiment, the connection portion includes a first connection portion which is connected to the cover body; the case body has a first side wall and a second side wall which are deposited relatively to each other; portion of the fixed base is deposited outside the side edges of the first side wall and the second side wall, and the side edges are in the shape of broken line or arc line; the portion beyond the side edge of the fixed base is coated with the first connection portion, which joins together with the side edge to form a butt joint. The connection portion in this embodiment further includes a second connection portion which is formed at one end of the first connection portion, and the end is far away from the cover body; the second connection portion is configured for connecting with the case body in rotation; and the second connection portion joins together with the edge of the bottom of the case body to form a bottom of the electronic cigarette case. And the electronic cigarette case includes a rotating mechanism; the rotating mechanism includes a first rotating shaft and a first rotating slot, the first rotating shaft is protruding from two sides of the second connection portion; the first rotating slot is deposited in the positioned matching with the first rotating shaft in the case body; the first shaft is inserted into the first rotating slot, and can rotate within the first rotating slot.

Still in this embodiment, the rotating mechanism further includes a first guiding portion; the first guiding portion is connected with the first rotating slot, and is configured to guide the first rotating shaft into the first rotating slot; the first guiding portion is a slot with its width matching with the first rotating shaft. And a limiting portion is formed between the first guiding portion and the first rotating slot, and the first limiting portion is a corner slot, a bulge and a recess are formed separately on the two side walls of the corner slot.

In another embodiment, the connection portion includes a third connection portion which is connected to the cover body; the third connection portion is a flat rod, and the third connection portion and one side of the case body joins together to form the side wall of the electronic cigarette case. In this embodiment, the connection portion further includes a driving portion which is formed by bending one end of the third connection portion in the direction of far away from the cover body, and the cover body is deposited in the same direction with the driving portion; the driving portion and the bottom of the case body join together to form the bottom surface of the electronic cigarette case; and when opening the case cover, the driving portion rotates, and the end of the driving portion resists with the bottom of the fixed base, driving the fixed base moving along the direction of taking the cigarette out relative to the case body.

The electronic cigarette case in this embodiment also includes a rotating mechanism; the rotating mechanism includes a second rotating shaft and a second rotating slot, the second rotating shaft is protruding from two sides of one ends of the third connection portion, and the end is close to the driving portion; the second rotating slot is deposited in the position matching with the second rotating shaft in the case body; the second rotating shaft is inserted into the second rotating slot, and can rotate within the second rotating slot. The rotating mechanism in this embodiment further includes a second guiding portion; the second guiding portion is connected with the second rotating slot, and is configured to guide the second rotating shaft into the second rotating slot; the second guiding portion is a slot with its width matching with the second rotating shaft. In this embodiment, a second limiting portion is formed between the second guiding portion and the second rotating slot, and the second limiting portion is a corner slot, a bulge and a recess are formed separately on the two side walls of the corner slot.

When implementing the electronic cigarette case of the present application, the following advantageous can be achieved: by the connection portion on one side of the cover body of the case cover extending along the top end far away from the cover body to the bottom of the case body, and forming an opening on the case body with the shape matching with the shape of the case cover, and make the connection portion connected with the case body in rotation by the rotation mechanism, thus when opening the cover, the electronic cigarette can open in large area, the opening scope is large, which is convenient to take the cigarette out and meet with the personalized needs of the customers.

BRIEF DESCRIPTION OF THE DRAWINGS

The present application will be further described with reference to the accompanying drawings and embodiments in the following, in the accompanying drawings.

DETAILED DESCRIPTION OF THE PREFERRED EMBODIMENT

In order to make the technical features, the propose and the technical effect of the present application more clearly, the present application will now be described in detail with reference to the accompanying drawings and embodiments.

Figure 1:
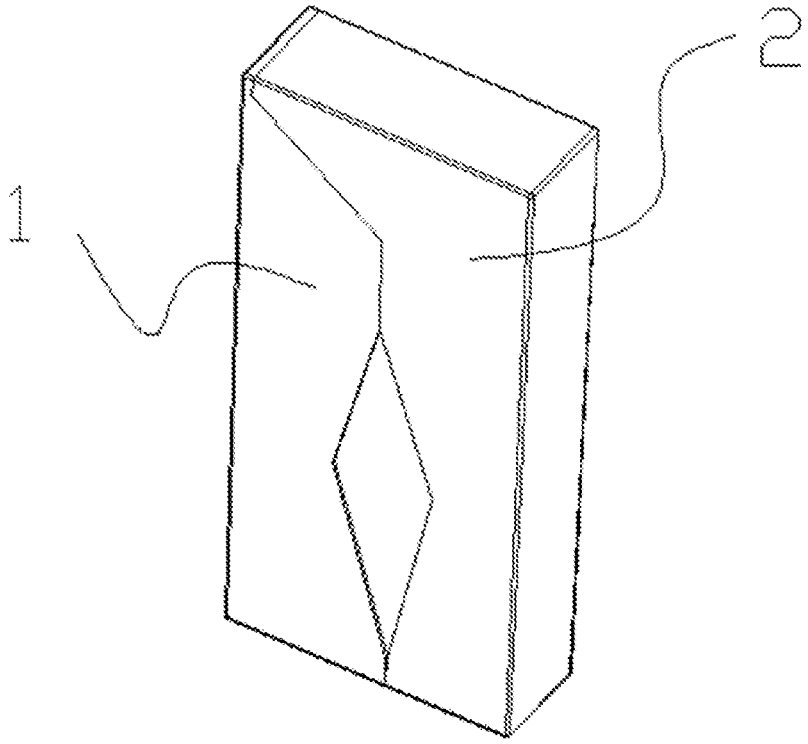
FIG. 1 illustrates a schematic view of an electronic cigarette case according to a first embodiment of the present application.
Figure 2:
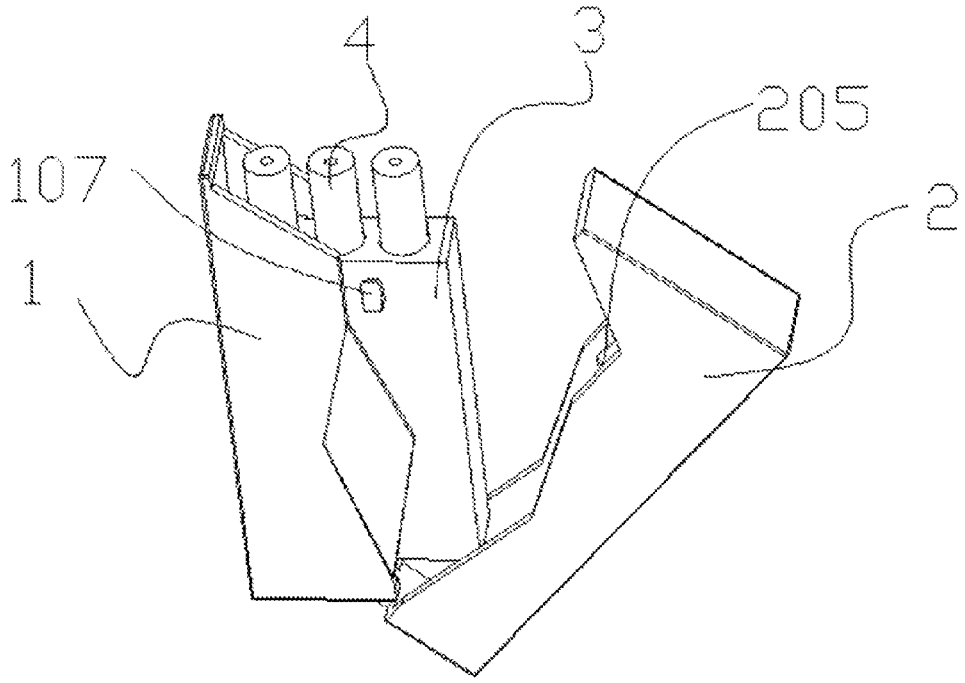
FIG. 2 illustrates a schematic view of the electronic cigarette case with a case cover shown in FIG. 1 in an opening state.
Figure 3:
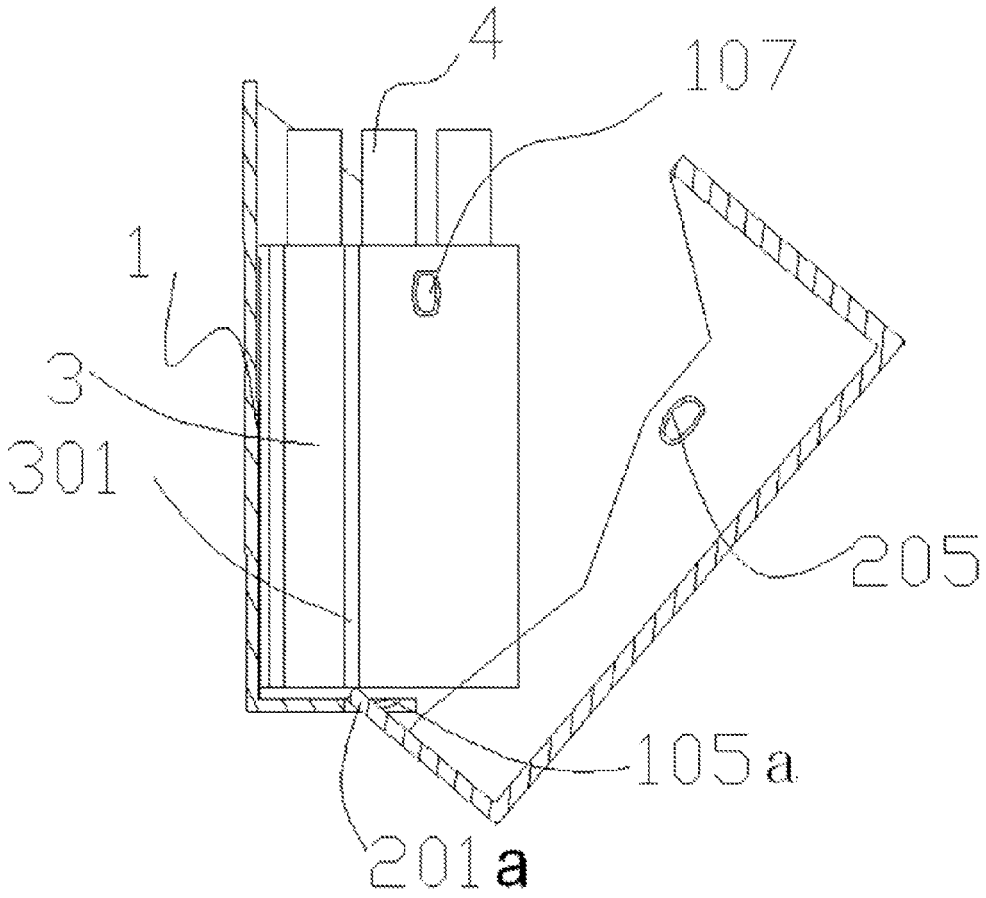
FIG. 3 illustrates a cutaway view of the electronic cigarette case in the opening state of the present application.
Figure 4:
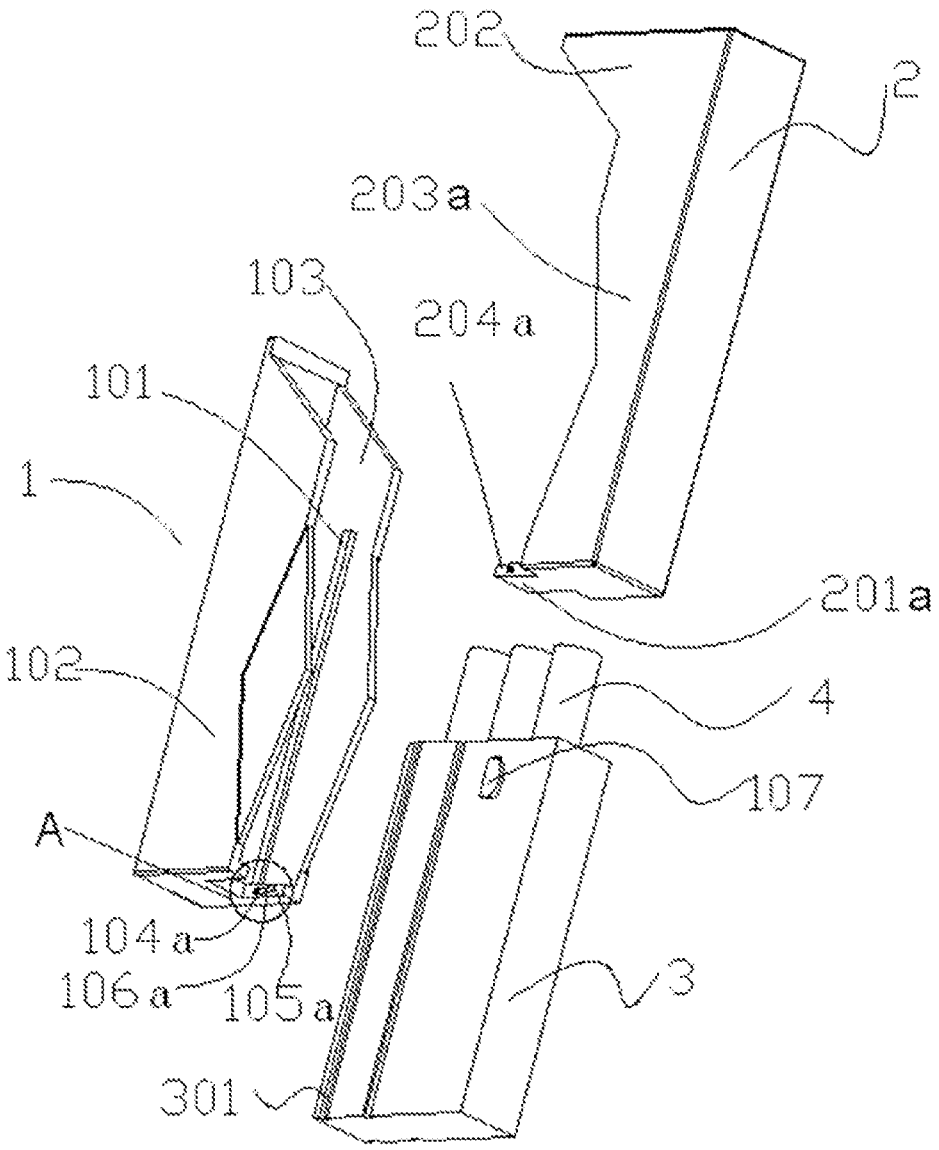
FIG. 4 illustrates a disassembled view of FIG. 1.
Figure 5:
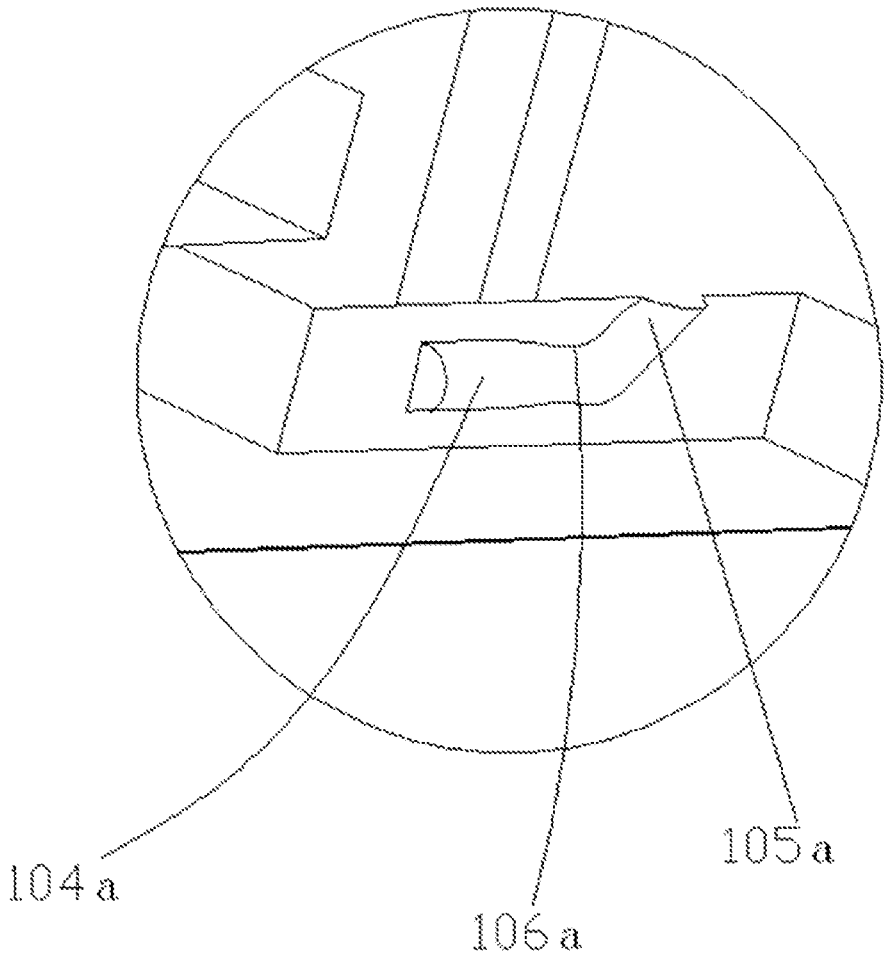
FIG. 5 illustrates an enlarged view of A portion shown in FIG. 4.
Figure 6:
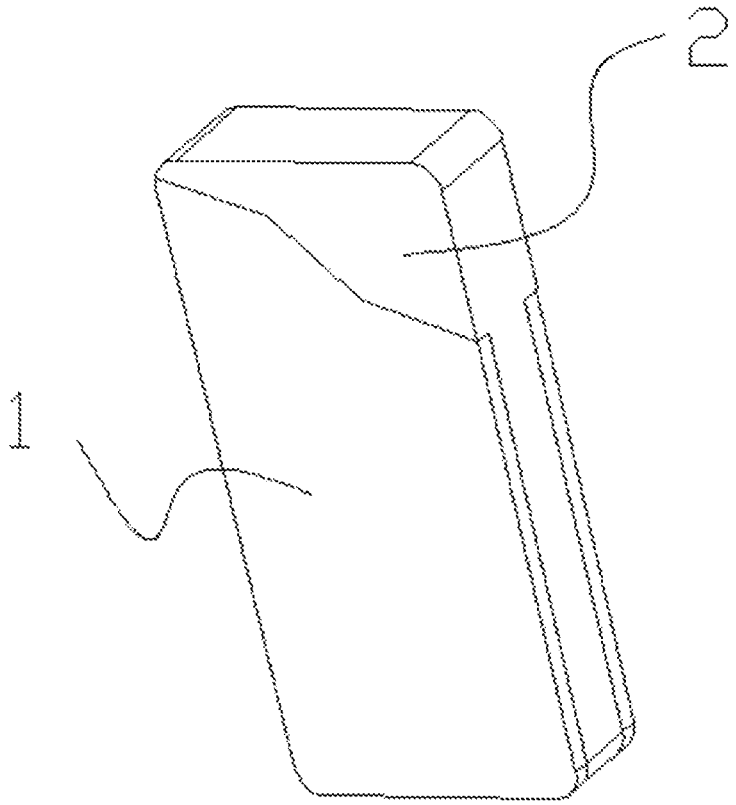
FIG. 6 illustrates a schematic view of an electronic cigarette case according to a second embodiment of the present application.
Figure 7:
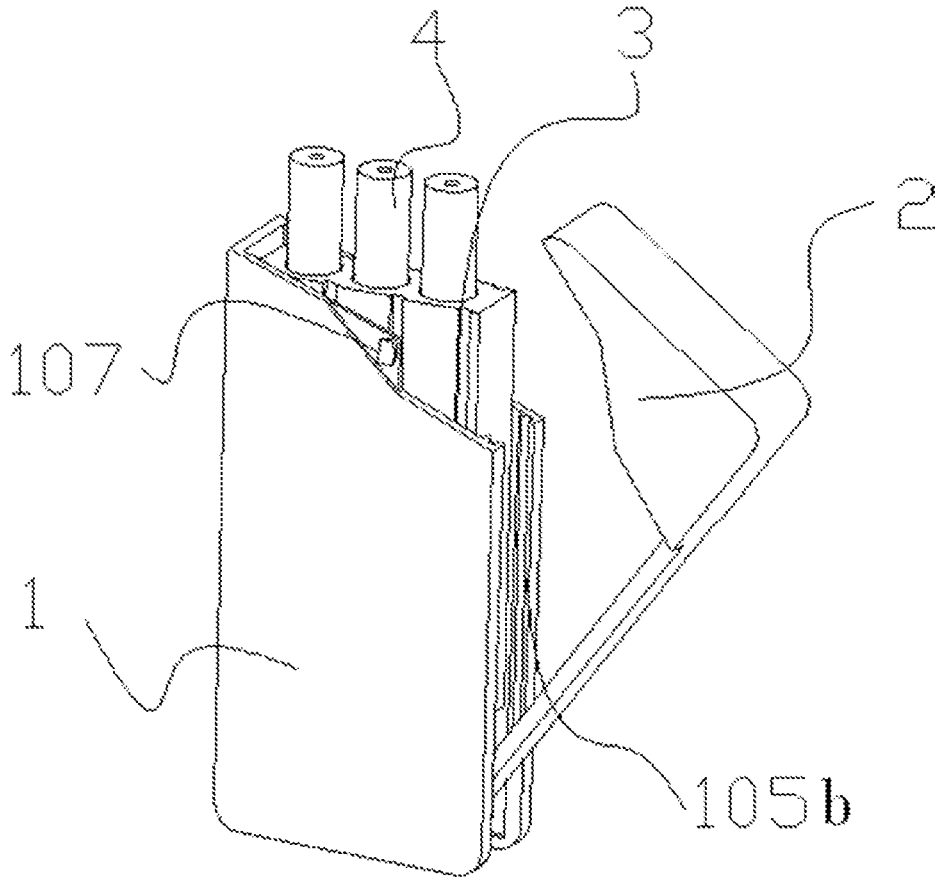
FIG. 7 illustrates a schematic view of the electronic cigarette case with a case cover shown in FIG. 6 in an opening state.
Figure 8:
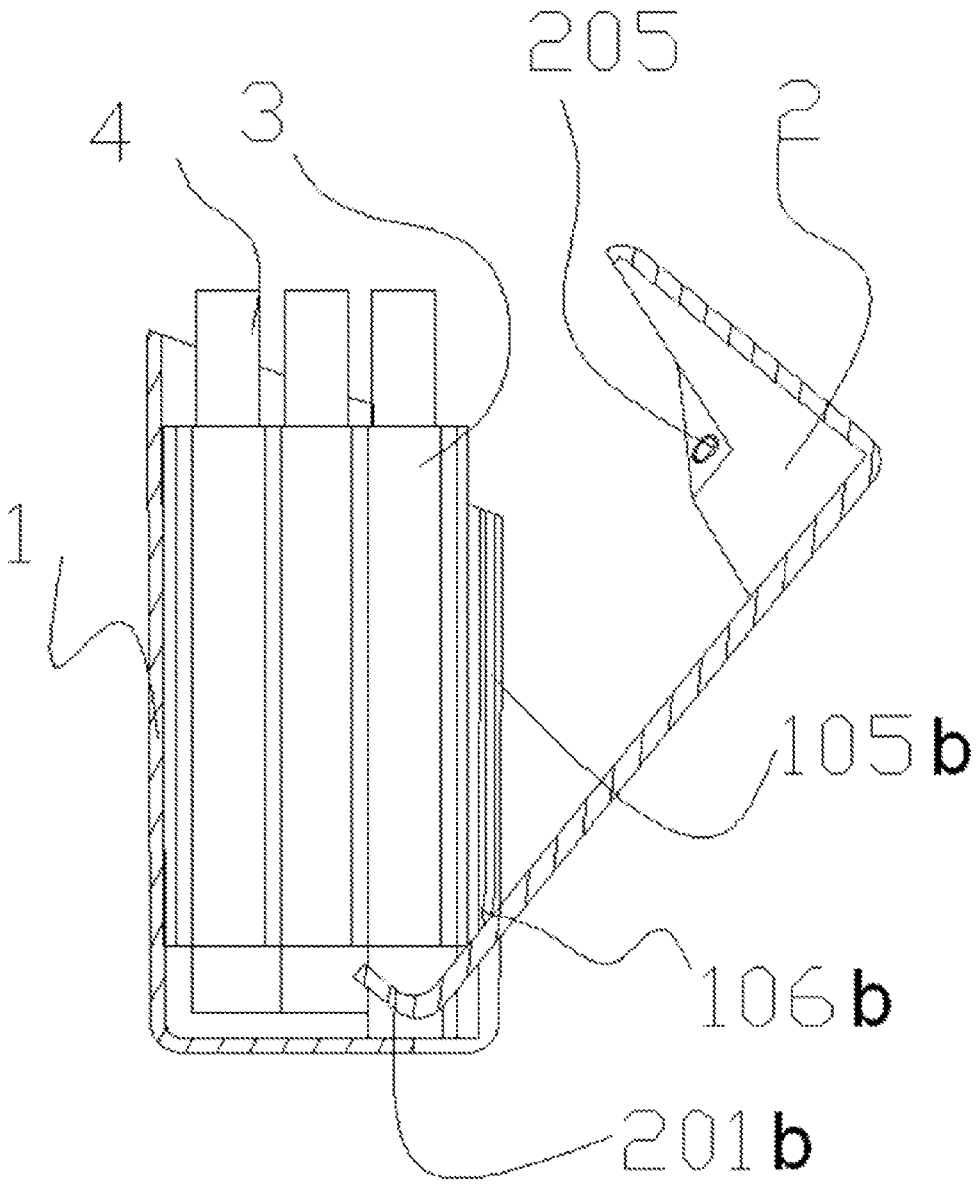
FIG. 8 illustrates a cutaway view of the electronic cigarette case in the opening state according to the second embodiment of the present application.
Figure 9:
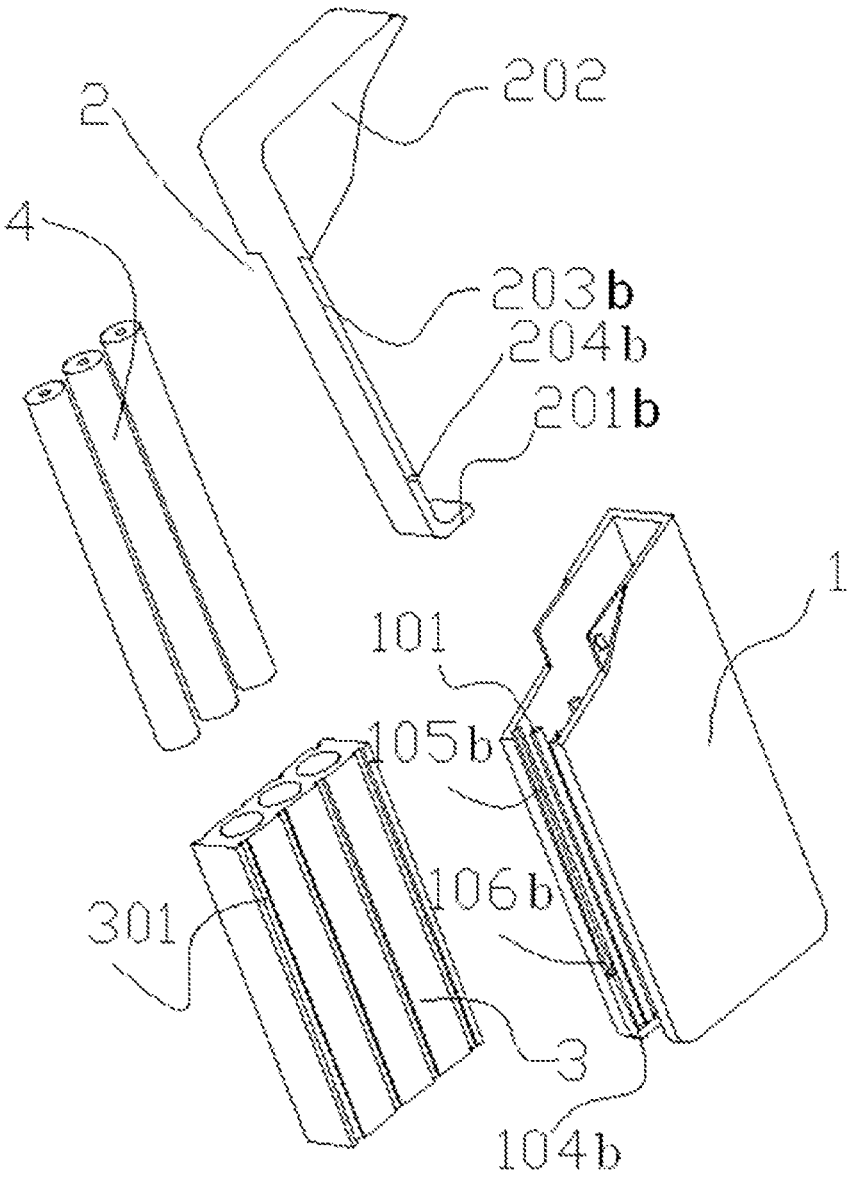
FIG. 9 illustrates a disassembled view of FIG. 6.

As shown in FIG. 1 to FIG. 9, the present application provides an electronic cigarette case, which comprises a case body 1 with an opening defined on the top of the case body 1 and a case cover 2 which covers the case body 1. The case cover 2 comprises a cover body 202 and a connection portion, which is extending from one side of the cover body 202 to the bottom of the case body 1 in the direction of far away from the top of the cover body 202. A notch corresponding to the position of the case cover 2 is defined in the case body 1, the shape of the notch matches with the shape of the case cover 2, and the connection portion is connected to the case body 1 rotationally by a rotation mechanism. The shape of the notch matching with the shape of the case cover 2 described above refers to the shapes of the edges of the notch match with the shapes of the edges of the case cover 2.

Specifically, the inside of the case body 1 and the inside of the case cover 2 together form an accommodation cavity for accommodating electronic cigarettes 4. The electronic cigarette case includes a fixed base 3 which is configured for inserting the electronic cigarettes 4. The fixed base 3 is deposited within the inside of the accommodation cavity, and can slide relative to the case body 1 along the direction of inserting the electronic cigarettes 4. Preferably, a sliding rod 101 is mounted on the inner wall of the case body 1, and a sliding slot 301 matching with the sliding rod 101 is formed on the outer wall of the fixed base 3; or a sliding rod 101 is mounted on the outer wall of the fixed base 3 and a sliding slot 301 matching with the sliding rod 101 is formed on the inner wall of the case body 1. The sliding rod 101 may be slidably deposited within the sliding slot 301.

It may be understood that, the method that fixed base 3 sliding relative to the case body 1 along the direction of inserting the electronic cigarettes 4 may be through roller or sliding slot, and the sliding rod 101 mentioned above may be a sliding block. The mounting method between the case cover 2 and the case body 1 may be described with the following two embodiments.

Embodiment 1

As shown in FIGS. 1-5, the connection portion includes a first connection portion 203*a* which is connected with the cover body 202, and a second connection portion 201*a* which is formed at one end of the first connection portion 203*a*, and the end is far away from the cover body 202, and the second connection portion 201*a* is configured for connecting to the case body 1 rotationally. The case body 1 has a first side wall 102 and a second side wall 103 which are deposited relatively to each other. Portion of the fixed base 3 is deposited outside the side edges of the first side wall 102 and the second side wall 103, and the side edges are in the shape of broken line or arc line. The portion beyond the side edge of the fixed base 3 is coated with the first connection portion 203*a*, which joins together with the side edge to form a butt joint. The second connection portion 201*a* joins together with the edge of the bottom of the case body 1 to form a bottom of the electronic cigarette case.

At this moment, the longitudinal cross-section of the case cover 2 is in the shape of U, and since the fixed base 3 reaches beyond the edges of the first side wall 102 and the second side wall 103, it can not only be ensure that the opening of the case cover is large, but also meet the needs of the pattern on the side face of the cigarette case, which achieves both effects of the beauty and convenience to take the cigarette out.

It can be understood that, the second connection portion 201*a* is a connection sheet extending from the first connection portion 203*a* and is positioned in the same direction with the cover body 202. The length of the second connection portion 201*a* may be relatively short, and only plays a role of connecting to the case body 1. However, the length of the second connection portion 201*a* may be relatively long, and it may also play a role of driving the fixed base 3 to move along the direction of inserting the electronic cigarette 4.

Specifically, when the length of the second connection portion 201*a* is relatively long, it will drive the fixed base 3 moving as following: when opening the case cover 2, the second connection portion 201*a* rotates, the end of the second connection portion 201*a* resists with the bottom of the fixed base 3, and such that the fixed base 3 is driven to move in the direction of taking out the cigarette relative to the case body 1.

Since the fixed base 3 is portion deposited within the case body 1, preferably, both the number of the sliding rods 101 and the number of the sliding slots 301 are two.

The electronic cigarette case includes a rotating mechanism. The rotating mechanism includes a first rotating shaft 204*a* and a first rotating slot 104*a*, the first rotating shaft 204*a* is protruding from two sides of one ends of the second connection portion 201*a*, and the end is close to the first connection portion 203*a*. The first rotating slot 104*a* is deposited in the positioned matching with the first rotating shaft 204*a* in the case body 1; the first shaft 204 is inserted into the first rotating slot 104*a*, and can rotate within the first rotating slot 104*a*.

The rotating mechanism further includes a first guiding portion 105*a*; the first guiding portion 105*a* is connected with the first rotating slot 104*a*, and is configured to guide the first rotating shaft 204*a* into the first rotating slot 104*a*. The first guiding portion 105*a* is a slot with its width matching with the first rotating shaft 204*a*.

A first limiting portion 106*a* is formed between the first guiding portion 105*a* and the first rotating slot 104*a*, and the first limiting portion 106*a* is a corner slot, a bulge and a recess are formed separately on the two side walls of the corner slot. Advantageously, the bulge is an arc-shaped bulge.

In the present embodiment, the first guiding portion 105*a* is in the shape of arc-line, specifically, the first guiding portion 105*a* is an opening defined on the bottom surface of the case body 1, the surface adjacent to the fixed base 3 or the surface far away from the fixed base 3; and the opening further extends to the first rotating slot 104*a*. The first guiding portion 105*a* may be in the shape of straight-line, that is, it is a linear slot parallel to the bottom surface of the case body 1.

The electronic cigarette case further includes a buckling part which is configured to buckle together the case body 1 and the case cover 2. The buckling part includes a buckle 107 which is mounted on the case body 1 or the fixed base 3, and a buckle placement 205 matching with the buckle 107 which is formed on the case cover 2; when the cover is closed, the buckle 107 is deposited within the buckle placement 205. In the present embodiment, since the fixed base 3 is protruding the case body 1, for the convenience of mounting, the buckle 107 is positioned on the fixed base 3, and the buckle placement 205 is formed on the case cover 2.

Embodiment 2 the connection portion includes a third connection portion 203*b* which is connected to the cover body 202, a driving portion 201*b* is formed by bending one end of the third connection portion 203*b* in the direction of far away from the cover body 202, and the cover body 202 is deposited in the same direction with the driving portion 201*b*, the driving portion 201*b* and the bottom of the case body 1 join together to form the bottom surface of the electronic cigarette case. When opening the case cover 2, the driving portion 201*b* rotates, and the end of the driving portion 201*b* resists with the bottom of the fixed base 3, driving the fixed base 3 moving along the direction of taking the cigarette out relative to the case body 1.

As shown in FIGS. 6-9, in the present embodiment, the third connection portion 203*b* is a flat rod, and the third connection portion 203*b* and one side of the case body 1 join together to form the side wall of the electronic cigarette case. In the present embodiment, preferably, the number of the sliding rods 101 and the number of the sliding slots 301 are both four.

In the present embodiment, the electronic cigarette case also includes a rotating mechanism. The rotating mechanism includes a second rotating shaft 204*b* and a second rotating slot 104*b*, the second rotating shaft 204*b* is protruding from two sides of one ends of the third connection portion 203*b*, and the end is close to the driving portion 201*b*. The second rotating slot 104*b* is deposited in the position matching with the second rotating shaft 204*b* in the case body 1; the second rotating shaft 204*b* is inserted into the second rotating slot 104*b*, and can rotate within the second rotating slot 104*b*.

As the same as the first embodiment, the rotating mechanism further includes a second guiding portion 105*b*; the second guiding portion 105*b* is connected with the second rotating slot 104*b*, and is configured to guide the second rotating shaft 204*b* into the second rotating slot 104*b*. The second guiding portion 105*b* is a slot with its width matching with the second rotating shaft 204*b*.

A second limiting portion 106*b* is formed between the second guiding portion 105*b* and the second rotating slot 104*b*, and the second limiting portion 106*b* is a corner slot, a bulge and a recess are formed separately on the two side walls of the corner slot.

It could be understood that, in the present embodiment, the second rotating shaft 204*b* is positioned at the end of the third connection portion 203*b* which is close to the driving portion 201*b*, that is, the second rotating shaft 204*b* is mounted in position of the third connection portion 203*b* corresponding to the side face of the case body 1. However, in the first embodiment, the first rotating shaft 204*a* is positioned at the end of the second connection portion 201*a* which is close to the first connection portion 203*a*, that is, the first rotating shaft 204*a* is mounted in the position of the second connection portion 201*a* corresponding to the bottom of the case body 1.

In the present embodiment, the electronic cigarette case further includes a buckling part which is configured to buckle the case body 1 and the case cover 2. The buckling part includes a buckle 107 which is mounted on the case body 1 or the fixed base 3, and a buckle placement 205 matching with the buckle 107 which is formed on the case cover 2; when the cover is closed, the buckle 107 is deposited within the buckle placement 205. Preferably, for the convenience of mounting, the buckle 107 is positioned on the fixed base 3, and the buckle placement 205 is formed on the case cover 2.

To sum up, by the connection portion on one side of the cover body 202 of the case cover 2 extending along the top end far away from the cover body 202 to the bottom of the case body 1, and forming an opening on the case body 1 with the shape matching with the shape of the case cover 2, and make the connection portion connected with the case body 1 rotationally by the rotation mechanism, thus when opening the cover, the electronic cigarette can open in large area, the opening scope is large, which is convenient to take the cigarette out and meet with the personalized needs of the customers.

Although the present application is illustrated with the embodiments accompanying the drawings, the present application is not limited to the above-mentioned specific embodiments, and the above-mentioned embodiments are only for illustration, not for limitation. In the inspiration of the present, those skilled in the art may make many modifications for the present application, without going beyond the purpose and the scope the claims intend to protect of the present application, such as the case cover formed integrated with the cover body, all these belong to the protection of the present application.

What is claimed is:

1. An electronic cigarette case, comprising a case body with an opening defined on the top of the case body, and a case cover which covers the opening of the case body; the case cover includes a cover body and a connection portion which is extending from one side of the cover body to the bottom of the case body in the direction of far away from the top of the cover body; and the connection portion is connected to the case body rotationally;

wherein inside of the case body and inside of the case cover together form an accommodation cavity for accommodating electronic cigarettes; a fixed base is positioned within the accommodation cavity, which is configured for inserting the electronic cigarettes, and the fixed base can slide relative to the case body along direction of inserting the electronic cigarettes;

wherein the electronic cigarette case further includes a buckling part which is configured to buckle together the case body and the case cover; the buckling part includes a buckle which is mounted on the case body or the fixed base, and a buckle placement matching with the buckle which is formed on the case cover; when the cover is closed, the buckle is deposited within the buckle placement; and wherein the connection portion includes a first connection portion which is connected to the cover body; the case body has a first side wall and a second side wall which are deposited relatively to each other; portion of the fixed base is deposited outside side edges of the first side wall and the second side wall, and the side edges are in the shape of broken line or arc line; the portion beyond a side edge of the fixed base is coated with the first connection portion, which joins together with the side edge to form a butt joint.

2. The electronic cigarette case according to claim 1, wherein a sliding rod is mounted on inner wall of the case body, and a sliding slot matching with the sliding rod is formed on outer wall of the fixed base;

or a sliding rod is mounted on the outer wall of the fixed base and a sliding slot matching with the sliding rod is formed on the inner wall of the case body;

the sliding rod may be slidably deposited within the sliding slot.

3. The electronic cigarette case according to claim 1, wherein the connection portion further includes a second connection portion which is formed at one end of the first connection portion, and the end is away from the cover body; the second connection portion is configured for connecting to the case body rotationally; and the second connection portion joins together with an edge of the bottom of the case body to form a bottom of the electronic cigarette case.

4. The electronic cigarette case according to claim 3, wherein the electronic cigarette case includes a rotating mechanism; the rotating mechanism includes a first rotating shaft and a first rotating slot, the first rotating shaft is protruding from two sides of the second connection portion; the first rotating slot is deposited in the positioned matching with the first rotating shaft in the case body;

the first shaft is inserted into the first rotating slot, and can rotate within the first rotating slot.

5. The electronic cigarette case according to claim 4, wherein the rotating mechanism further includes a first guiding portion; the first guiding portion is connected with the first rotating slot, and is configured to guide the first rotating shaft into the first rotating slot; the first guiding portion is a slot with its width matching with the first rotating shaft.

6. The electronic cigarette case according to claim 5, wherein a limiting portion is formed between the first guiding portion and the first rotating slot, and the first limiting portion is a corner slot; a bulge and a recess are formed separately on the two side walls of the corner slot.

* * * * *